United States Patent [19]

Folkins

[11] Patent Number: 4,786,924

[45] Date of Patent: Nov. 22, 1988

[54] HYBRID CONTROL SYSTEM FOR A COPIER

[75] Inventor: Jeffrey J. Folkins, Rochester, N.Y.

[73] Assignee: Xerox Corporation, Stamford, Conn.

[21] Appl. No.: 28,518

[22] Filed: Mar. 20, 1987

[51] Int. Cl.[4] ..... G03G 15/08

[52] U.S. Cl. ..... 355/3 DD; 355/14 D

[58] Field of Search ..... 355/3 DD, 14 D, 14 CH

[56] References Cited

U.S. PATENT DOCUMENTS

| | | | |
|---|---|---|---|
| 3,932,034 | 1/1976 | Takahashi | 355/3 DD |
| 4,026,643 | 4/1977 | Bergman | 355/3 DD |
| 4,141,645 | 2/1979 | Reid et al. | 355/3 DD |
| 4,194,828 | 3/1980 | Holz et al. | 355/3 DD |
| 4,279,498 | 7/1981 | Eda et al. | 355/3 DD X |
| 4,318,610 | 3/1982 | Grace | 355/14 D |
| 4,455,090 | 6/1984 | Roberts | 356/448 |
| 4,466,731 | 8/1984 | Champion et al. | 355/3 DD X |
| 4,468,112 | 8/1984 | Suzuki | 355/14 D |
| 4,492,179 | 1/1985 | Folkins et al. | 118/689 |
| 4,502,778 | 3/1985 | Dodge et al. | 355/14 E |
| 4,533,234 | 8/1985 | Watai et al. | 355/14 D |
| 4,553,033 | 11/1985 | Hubble, III et al. | 250/353 |
| 4,563,086 | 1/1986 | Knapp et al. | 355/3 DD X |
| 4,589,762 | 5/1986 | DeSchamphelaere et al. | 355/14 D |

FOREIGN PATENT DOCUMENTS

| | | | |
|---|---|---|---|
| 55-111970 | 8/1980 | Japan | 355/3 DD |
| 2050649 | 5/1980 | United Kingdom . | |

OTHER PUBLICATIONS

IBM Technical Disclosure Bulletin, vol. 5, N. 3A, Aug. 1982, Pritner/Copier Photoconductor Electrostatic Sensor, By: Witcher, pp. 1092 & 1093.

*Primary Examiner*—A. C. Prescott
*Assistant Examiner*—Jane Lau
*Attorney, Agent, or Firm*—H. Fleischer; J. E. Beck; R. Zibelli

[57] ABSTRACT

An apparatus which measures the electrical current biasing a developer roller and transmits a control signal corresponding thereto to control discharging of marking particles in a development system of an electrophotographic printing machine. At selected intervals, the control signal is adjusted as a function of the measured mass to area ratio of the marking particles deposited on a test area recorded on the photoconductive member.

13 Claims, 3 Drawing Sheets

HYBRID CONTROL SYSTEM FOR A COPIER

This invention relates generally to an electrophotographic printing machine, and more particularly concerns an apparatus for controlling various processing stations therein and, after a selected interval, correcting the control signal.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. Generally, the developer material comprises toner particles, i.e. marking particles, adhering triboelectrically to carrier granules. The toner particles are attracted from the carrier granules to form a toner powder image on the photoconductive member which corresponds to the informational areas contained within the original document. This toner powder image is subsequently transferred to a copy sheet and permanently affixed thereto in image configuration.

In today's highly competitive business enviroment, only a product which is capable of reproducing copies in a continuously reliable, aesthetically pleasing manner is successful. It has been found that the characteristics of the processing stations vary and are not necessarily always repeatable with the passage of time. The utilization of various closed loop systems in the printing machine insure that the optimized characteristics of the printing machine are maintained over the life of the machine. Developer material characteristics frequently change. Toner particles age and the charge to mass ratio changes. In addition, toner particles are depleted from the developer mixture as they are used to form copies. The depletion of toner particles is measured and additional toner particles are added to the development system as required. The characteristics of the photoconductive member change with the passage of time. By controlling charging, exposure and development, the changing characteristics of the photoconductive member and developer material are corrected to optimize copy quality. Hereinbefore, the control system was not periodically corrected. This resulted in system drift and degradation in copy quality.

Various types of control systems for regulating the parameters of an electrophotographic printing machine have been devised. The following disclosures appear to be relevant:

- U.S. Pat. No. 4,194,828 Patentee: Holz et al. Issued: May 25,1980
- U.S. Pat. No. 4,318,610 Patentee: Grace Issued: Mar. 9, 1982
- U.S. Pat. No. 4,455,090 Patentee: Roberts Issued: June 19, 1984
- U.S. Pat. No. 4,492,179 Patentee: Folkins et al. Issued: Jan. 8, 1985
- U.S. Pat. No. 4,502,778 Patentee: Dodge et al. Issued: Mar. 5, 1985
- U.S. Pat. No. 4,533,234 Patentee: Watai et al. Issued: Aug. 6, 1985
- U.S. Pat. No. 4,553,033 Patentee: Hubble, III et al. Issued: Nov. 12, 1985

- U.S. Pat. No. 4,589,762 Patentee: De Schamphelacre et al. Issued: May 20, 1986
- U.K. Patent Application No. 2,050,649 Applicant: Lavery et al. Filed May 11, 1979
- IBM Technical Disclosure Bulletin Vol. 5, No. 3A, August 1982 Printer/Copier Photoconductor Electrostatic Sensor By: Witcher Pages 1092 & 1093
- Co-pending U.S. Application Ser. No. 490,267 Applicant: Folkins Filed: May 24, 1984
- Co-pending U.S. Application Ser. No. 392,965 Applicant: Folkins Filed: June 28, 1982

The pertinent portions of the foregoing disclosures may be briefly summarized as follows:

Holz et al. describes a developing electrode which includes a metal roller having a dielectric layer coated thereon. The developer electrode is coupled to an electrical circuit. In operation, the developer electrode measures the background voltage of an image free portion of the photoconductive surface and controls the development voltage in accordance with the measured background voltage.

Grace discloses an infrared densitometer positioned closely adjacent to a photoconductive surface. The infrared densitometer detects the density of toner particles adhering to a pair of test areas recorded on the photoconductive surface. The output signal resulting from the density of toner particles deposited on one of the test areas is used to regulate the charging of the photoconductive surface with the signal corresponding to the density of the toner particles adhering to the other test area being employed to control dispensing of toner particles into the developer mixture.

Witcher discloses a magnetic brush development system which includes at least one developer roller which is electrically isolated so that the developer roller can be used to sense the voltage developed on the roll during operation of the electrophotographic printing machine. In the test mode, one of the developer rollers develops a voltage thereon which is proportional to the charge level on the photoconductor. This voltage is sensed and the electrostatic charge levels adjusted to maintain constant process levels throughout the life of the photoconductor.

Roberts describes an apparatus that uses a photocell and reflected light to measure surface reflectance characteristics of a sheet. Standard black and white reference values are compared to the photocell signal after it has been digitized. A microprocessor system enables calculations of a mean and standard deviation of the photocell signal relative to the background.

Folkins et al. discloses a developer roll which transports developer material to a latent image recorded on a photoconductive surface. As the toner particles are deposited on the latent image, the developer roller senses the charge thereon. Additional toner particles are dispensed into the development system in response to the signal corresponding to the sensed charge.

Dodge et al. and Lavery et al. describe a patch sensing system for controlling the dispensing of toner particles in an electrophotographic printing machine. A signal corresponding to the reflectivity of the patch and a reference signal are stored and averaged. These signals are used to control the toner replenishment system.

Watai et al. discloses a phototransistor which measures the density of toner applied to the surface of a photoconductive drum. The signal from the phototransistor is compared to a reference. A CPU uses the error signal to control the bias voltage and the toner motor in the development system.

Hubble, III et al. describes an infrared reflectance densitometer. A control photodiode compensate for component degradation, a background photodiode compensates for background radiation, and a large area photodiode measures the amount of toner particles on a photosensitive surface.

De Schamphelacre et al. discloses two control units to regulate toner dispensing. The first unit is used to control toner density during the initial period of use of a new toner mixture by measuring actual toner concentration, i.e. amount of toner per unit volume, of discrete exposures of the photoconductor. The second control unit is responsive to the electrical permeability of the toner mixture.

Folkins Ser. No. 490,267 describes a magnetic brush development system wherein a developer roller is electrically biased and the current electrically biasing the developer roller is sensed. The sensed current corresponds to the electrical potential on the photoconductive surface.

Folkins Ser. No. 392,965 discloses a magnetic brush development system which operates in the developing or cleaning mode. Upon measuring the potential on the photoconductive surface, the voltage source electrically biasing the magnetic brush developer roller is disconnected therefrom, and the roller allowed to be electrically floating. The floating voltage is sensed in the inter-image region. The sensed electrical voltage corresponds to the potential on the photoconductive surface and is used to control various processing stations within the printing machine.

In accordance with one aspect of the present invention, there is provided an apparatus for controlling the discharge of marking particles into a development system of a printing machine adapted to have a test area recorded, at selected intervals, on a member. Means transport marking particles closely adjacent the member to deposit marking particles on the test area recorded thereon. Means are provided for electrically biasing the transporting means to a selected magnitude and polarity. Means sense the current electrically biasing the transporting means and transmit a signal proportional thereto. At selected intervals, means detect the mass to area ratio of the marking particles and transmit a signal proportional thereto. Means, responsive to the signals from the sensing means and the detecting means, generate a marking particle discharge signal.

Pursuant to another aspect of the present invention, an electrophotographic printing machine of the type having a photoconductive member and at least one processing station. The printing machine includes means for transporting marking particles closely adjacent photoconductive member. Means are provided for electrically biasing said transporting means to a selected magnitude and polarity. Means sense the current electrically biasing the transporting means and transmit a signal proportional thereto. At selected intervals, means generate a signal adapted to adjust the signal from the sensing means. Means, responsive to the signal from the sensing means and the generating means, produce a control signal to regulate the processing station.

Other aspects of the present invention will become apparent as the following description proceeds and upon reference to the drawings, in which.

While the present invention will be described hereinafter in conjunction with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
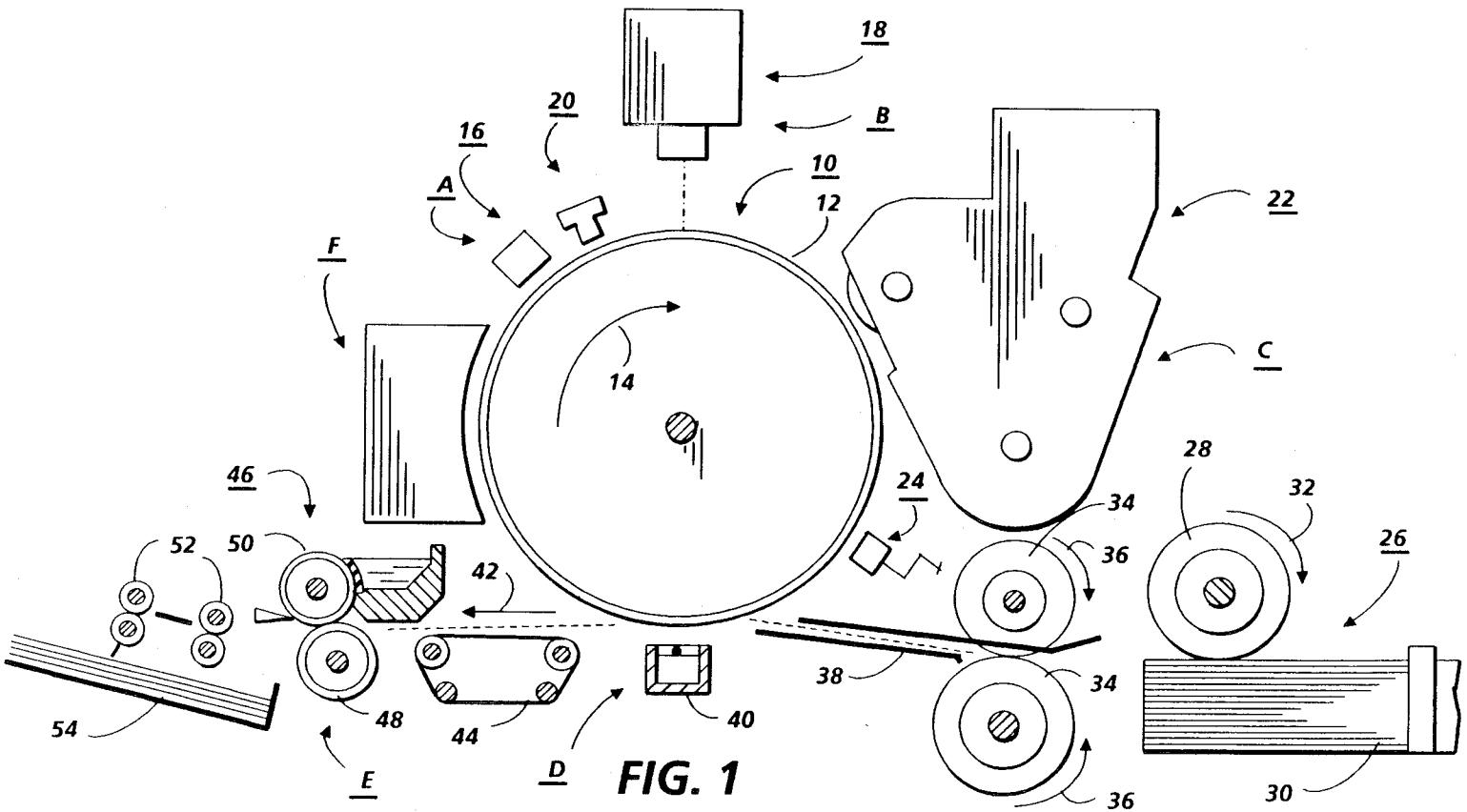
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the apparatus of the present invention therein. It will become evident from the following discussion that this apparatus is equally well suited for use in a wide variety of different types of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. Preferably, photoconductive surface 12 comprises a selenium alloy with the conductive substrate being an electrically grounded aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential. Corona generating device 16 has a charging electrode and a conductive shield positioned adjacent photoconductive surface 12. A change in output of the power supply connected thereto causes corona generating device 16 to vary the charge voltage applied to photoconductive surface 12.

Next, the charged portion of photoconductive surface 12 is advanced through imaging station B. Imaging station B includes an exposure system, indicated generally by the reference numeral 18. Exposure system 18 includes lamps which illuminate an original document positioned face down upon a transparent platen. The light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the information on the original document.

Imaging station B includes a test area generator, indicated generally by the reference numeral 20. Test area generator 20 comprises a light source electronically programmed to a prescribed output level. The light source is energized after a selected number of copies have been reproduced, e.g. 500 to 1000 copies, or after a selected interval of time, e.g. every 2 to 4 hours. In this way, a preselected intensity light image is projected, at selected intervals, onto the charged portion of photoconductive surface 12 to record a test area thereon. Preferably, the test area recorded on photoconductive surface 12 is a rectangle, 10 millimeters by 18 millimeters. After the electrostatic latent image or test area has been recorded on photoconductive surface 12, drum 10 advances the electrostatic latent image or test area, in the direction of arrow 14, to development station C.

At development station C, a magnetic brush development system, indicated generally by the reference numeral 22, transports a developer mixture of carrier granules having toner particles adhering triboelectrically thereto into contact with the electrostatic latent image or test area. Toner particles are attracted from the carrier granules to the latent image or test area forming a toner powder image or a developed test area. As successive images are developed, toner particles are depleted from the developer mixture. A toner particle dispenser disposed in development system 22 is arranged to furnish additional toner particles to the developer mixture for subsequent use thereby. A sensor is associated with the magnetic brush development system to sense the current electrically biasing the magnetic brush roller. A signal proportional to the sensed current is transmitted to the logic circuitry which develops a control signal for regulating the various processing stations, e.g. the toner particle dispenser furnishing additional toner particles to the development system. The detailed structure of development system 22 will be described hereinafter with reference to FIG. 2.

After development of the test area, the developed test area passes beneath a densitometer, indicated generally by the reference numeral 24. Densitometer 24 generates an electrical signal proportional to the toner mass of the test area. Any suitable densitometer may be employed and its characteristics will depend upon the color of the toner particles employed. The densitometer may operate in the visible or infrared wavelength of light. Preferably, densitometer 24 includes a light emitting diode and a photodiode. The light emitting diode directs light rays onto the developed test area. The photodiode receives light rays reflected from the toner particles on the developed test area. The photodiode converts the measured light ray input to an electrical output signal. This signal is transmitted to the logic circuitry to correct the control signal used to regulate the processing stations. Inasmuch as the test area is only recorded on the photoconductive surface at selected intervals, i.e. every 500 or 1000 copies, or every 2 to 4 hours, the control signal is only updated at these intervals.

After development of the electrostatic latent image, drum 10 advances the toner powder image to transfer station D. At transfer station D, a sheet of support material is moved into contact with the toner powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 30 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet into contact with photoconductive surface 12 in a timed sequence so that the toner powder image developed thereon contacts the advancing sheet at transfer station D.

Transfer station D includes a corona generating device 40 which sprays ions onto the backside of the sheet. This attracts the toner powder image from photoconductive surface 12 to the sheet. After transfer, the sheet continues to move in the direction of arrow 42 on conveyor 44 to advance to fusing station E.

Fusing station E includes a fuser assembly, indicated generally by the reference numeral 46, which permanently affixes the transferred toner powder image to the sheet. Preferably, fuser assembly 46 includes a back-up roller 48 and a heated fuser roller 50. The sheet passes between fuser roller 50 and back-up roller 48 with the powder image contacting fuser roller 50. In this manner, the toner powder image is permanently affixed to the sheet. After fusing, forwarding rollers 52 advance the sheet to catch tray 54 for subsequent removal from the printing machine by the operator.

After the powder image is transferred from photoconductive surface 12 to the copy sheet, drum 10 rotates the photoconductive surface to cleaning station F. At cleaning station F, a magnetic brush cleaning system removes the residual particles adhering to photoconductive surface 12. The magnetic brush cleaning system transports carrier granules closely adjacent to the photoconductive surface to attract residual toner particles thereto.

It is believed that the foregoing description is sufficient for purposes of the present invention to illustrate the general operation of an electrophotographic printing machine incorporating the features of the present invention therein.

Figure 2:
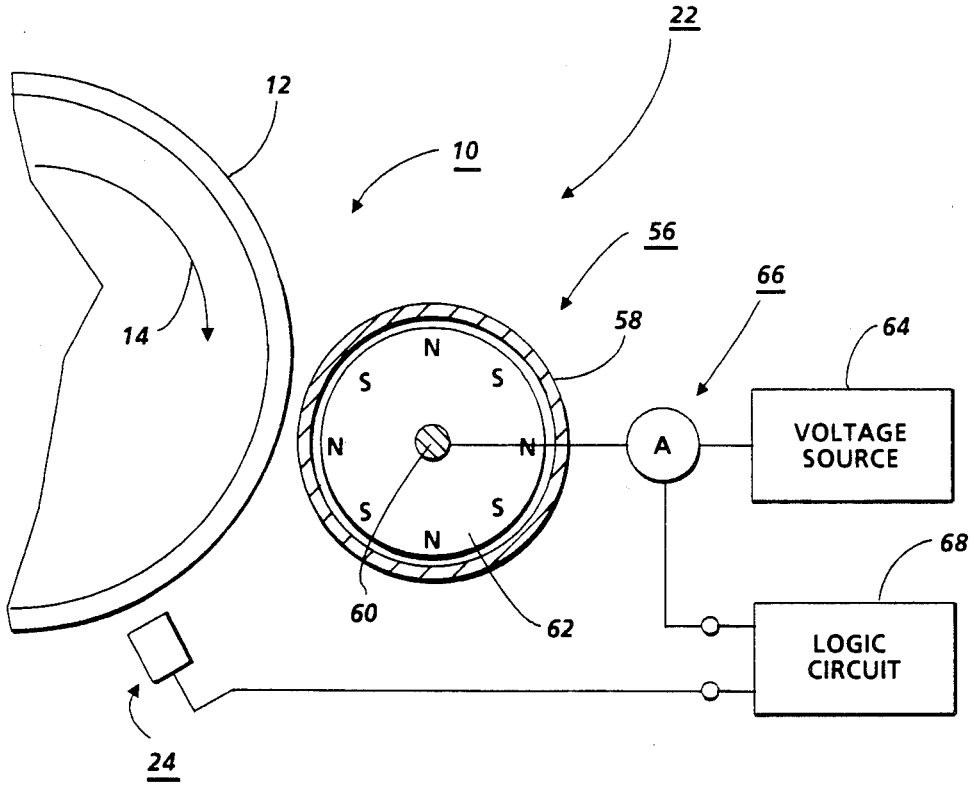
FIG. 2 is a schematic elevational view showing the development system of the FIG. 1 printing machine employing the control scheme of the present invention.

Referring now to the specific subject matter of the present invention, FIG. 2 depicts development system 22 in greater detail. As shown thereat, development system 22 includes a developer roller, indicated generally by the reference numeral 56. Developer roller 56 includes a non-magnetic tubular member 58 having an irregular or roughened exterior circumferential surface. Tubular member 58 is journalled for rotation by suitable means such as ball bearing mounts. A shaft assembly 60 is concentrically mounted within tubular member 58 and serves as a fixed mounting for an elongated magnetic member 62. Tubular member 58 rotates to advance the developer material into contact with photoconductive surface 12 of drum 10. By way of example, tubular member 58 is made preferably from aluminum with magnetic member 62 being made from barium ferrite. Magnetic member 62 has a plurality of magnetic poles impressed about the circumferential surface thereof. Shaft 60 is electrically conductive and couples tubular member 58 to voltage source 64 by a suitable means such as brushes or a commutator ring. In this way, current sensor 66 detects the current electrically biasing tubular member 58. The measured electrical biasing current is a function of the potential on the photoconductive surface and may be used to control the various processing stations within the printing machine.

In general, the scheme for controlling the dispensing of toner particles employs the densitometer to calibrate the bias current controller, or to over ride the toner dispenser and correct the toner concentration manually, i.e. it does not calibrate the bias current controller. The bias current controller operates at its previous setting, which may not be exactly correct, but is sufficiently correct. Under these circumstances, the bias controller operates in an open loop manner. Alternatively, the densitometer may over ride the toner dispenser and correct the toner concentration, and calibrate the current controller. More specifically, a signal from current sensor 66 corresponding to the measured current is transmitted to logic circuit 68. Logic circuit 68 processes the signal from current sensor 66 and develops a control signal for regulating the dispensing of tone particles. Further details of this type of system are described in U.S. Pat. No. 4,492,179 issued to Folkins et al. in 1985, the relevant portions thereof being hereby incorporated into the present application. Densitometer 24 is also electrically connected to logic circuit 68. At selected intervals, e.g. every 500 or 1000 copies or 2 to 4 hours, densitometer 24 transmits a signal to logic circuit 68 proportional to the toner mass to area ratio, i.e. the density of the toner particles deposited on the test area. This signal is used to correct the gain of the control signal regulating the dispensing of toner particles. Alternatively, the signal from densitometer 24 may be processed by logic circuit 68 and transmitted directly to the toner dispense system to correct its parameters. Thus, the signal from logic circuit 68 controlling the discharge of toner particles is a function of the electrical biasing current updated at selected intervals by the densitometer signal.

In substantially the same way that the densitometer periodically measures the density of the toner particles on the test area to calibrate the toner dispense control system, an electrostatic voltage probe (not shown) may be positioned adjacent the photoconductive surface to calibrate, at selected intervals, the electrostatic aspects of the bias controller. In this mode of operation, the current is used as a control signal for regulating the other processing stations in the printing machine. Further details of this type of system are described in copending U.S. patent application Ser. No. 490,267, filed May 2, 1983, the relevant portions thereof being hereby incorporated into the present application. An alternative to this approach is to employ the signal from the probe as the continuous control signal. Under these circumstances, the current signal from the developer roller is employed to correct, at selected intervals, the control signal from the probe. One example of a suitable probe is a tuning fork type of electrostatic voltage probe.

Figure 3:
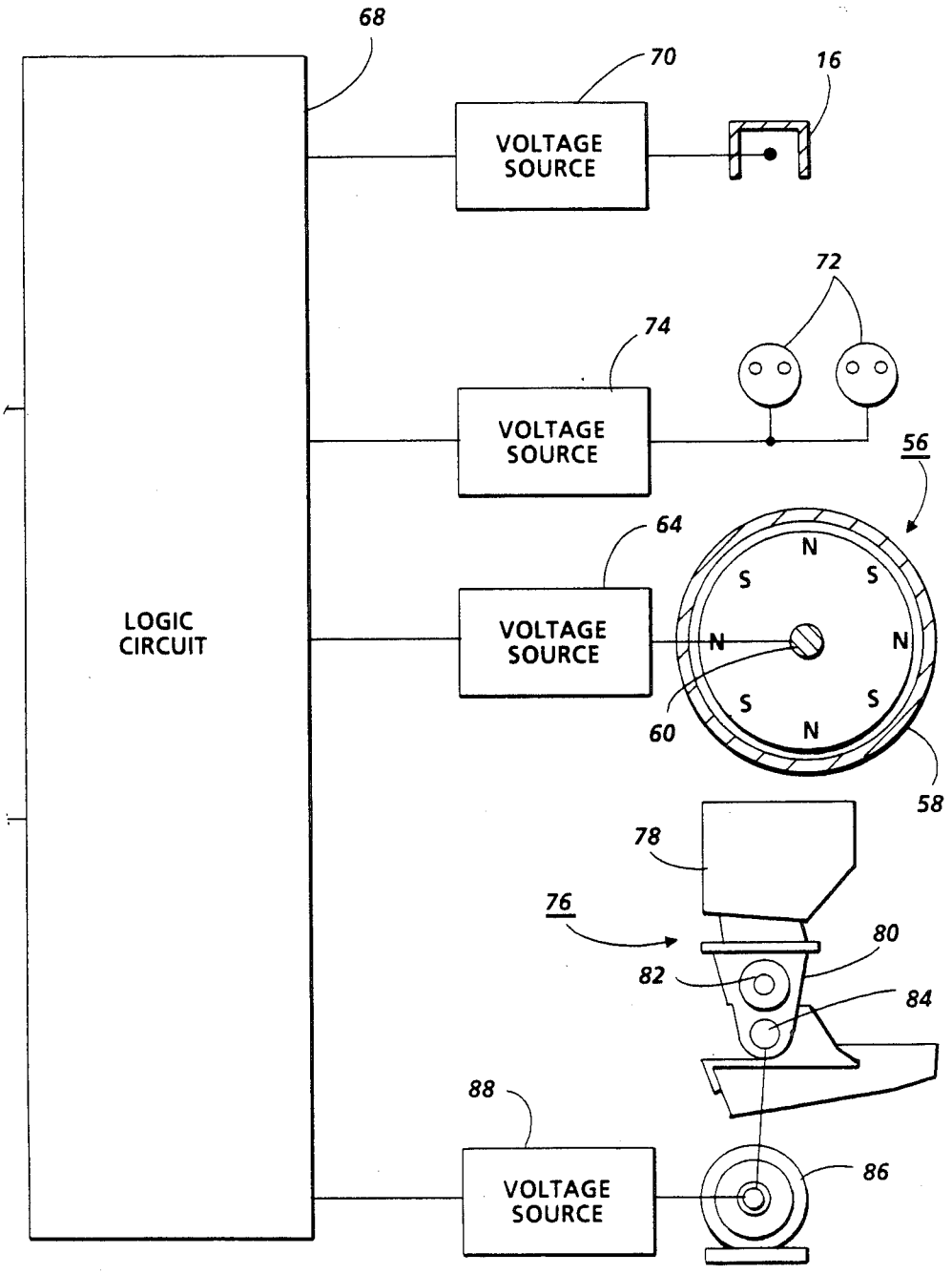
FIG. 3 is a schematic diagram illustrating the regulation of the various processing stations in the FIG. 1 printing machine.

Turning now to FIG. 3, there is shown the various processing stations within the electrophotographic printing machine that are regulated by the control signal from logic circuit 68. As shown thereat, logic circuit 68 transmits a control signal to voltage source 70. The control signal from logic circuit 68 regulates the output voltage from voltage source 70 so as to control corona generator 16.

Logic circuit 68 is also in communication with scan lamps 72 of exposure system 18. The control signal is used to regulate voltage source 74 exciting lamps 72. Preferably, lamps 72 are excited at a nominal value optimized for exposure. As a control signal is produced, the voltage applied to the lamps varies as a function thereof about the nominal value to compensate for deviations in conditions.

Logic circuit 60 also regulates developer roller 56 of development system 22. Voltage source 64 electrically biases tubular member 58 to a suitable polarity and magnitude. The selected electrical bias is intermediate the potential of the electrostatic latent image and the background regions of photoconductive surface 12. The control signal produced by logic circuit 68 is employed to regulate the output voltage from voltage source 64. In this way, the electrical bias applied to tubular member 58 is controlled to optimize conditions within the printing machine.

As toner particles are depleted from the developer mixture during the development process, additional toner particles are furnished thereto. Logic circuit 68 also controls the furnishing of additional toner particles to the development system. The toner dispenser, indicated generally by the reference numeral 76 is disposed in development station 22. Toner dispenser 76 includes a container 78 storing a supply of toner particles therein. A foam roller 80 is disposed in sump 82 coupled to container 78 for dispensing toner particles into auger 84. Auger 84 has a helical spring mounted in a tube having a plurality of apertures therein. Motor 86 rotates the helical member of auger 84 so as to advance the toner particles through the tube. The toner particles are then dispensed from the apertures thereof into the chamber of the development system housing developer roller 56. Energization of motor 86 is controlled by voltage source 88. Voltage source 88 is connected to logic circuit 68. The control signal from logic circuit 68 regulates voltage source 88 which, in turn, energizes motor 86. In this way, additional toner particles are furnished to the development system as required by conditions within the printing machine.

By way of example, logic circuit 68 includes a suitable discriminator circuit for comparing a reference with the signal proportional to the electrical biasing current. The discriminator circuit may utilize a control switch adapted to turn on and effectively lock an electrical output signal having a magnitude related to the input reference corresponding to the electrical biasing current. The resultant control signal is then multiplied by the appropriate proportionality constant and utilized to control the voltage sources associated with the corona generating device, scan lamps, developer roller, and toner dispenser. At selected intervals of time, the proportionality constant is adjusted as a function of the signal from the densitometer for controlling toner particle dispensing. The proportionality constant is adjusted as a function of the signal from the probe for controlling the other processing stations within the printing machine. In the alternate mode of operation, wherein the continuous control signal is proportional to the signal from the probe, the proportionality constant is adjusted as a function of the signal corresponding to the electrical biasing current.

In recapitulation, it is clear that the apparatus of the present invention controls the various processing stations within the electrophotographic printing machine as a function of a control signal which is adjusted, at selected intervals, by a calibration signal. A system of this type has low toner particle consumption while maintaining control stability.

It is, therefore, apparent that there has been provided, in accordance with the present invention, a hybrid control system that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and scope of the appended claims.

I claim:

1. An apparatus for controlling the discharge of marking particles into a development system of a printing machine adapted to have a test area recorded, at selected intervals, on a member, including:

means for transporting marking particles closely adjacent the member to deposit marking particles on the test area recorded thereon;

means for electrically biasing said transporting means to a selected magnitude and polarity;

means for sensing current electrically biasing said transporting means and transmitting a signal proportional thereto;

means for detecting, at selected intervals, the mass to area ratio of the marking particles deposited on the test area and transmitting a signal proportional thereto; and means, responsive to the signal from said sensing means and from said detecting means, for generating a marking particle discharge signal.

2. An apparatus according to claim 1, wherein said detecting means includes a densitometer positioned adjacent said member.

3. An apparatus according to claim 2, wherein said transporting means includes:

a tubular member mounted rotatably for transporting the marking particles adjacent the member; and an elongated magnetic member disposed interiorly of and spaced from said tubular member.

4. An apparatus according to claim 3, wherein said electrical biasing means includes a voltage source.

5. An electrophotographic printing machine of the type having a photoconductive member and at least one processing station, wherein the improvement includes:

means for transporting marking particles closely adjacent the photoconductive member;

means for electrically biasing said transporting means to a selected magnitude and polarity;

means for sensing current electrically biasing said transporting means and transmitting a signal proportional thereto;

means for generating, at selected intervals, a signal adapted to adjust the signal from said sensing means; and means, responsive to the signal from said sensing means and from said generating means, for producing a control signal for regulating the processing station.

6. A printing machine according to claim 5, wherein said transporting means includes:

a tubular member mounted rotatably for transporting the marking particles adjacent the photoconductive member; and an elongated magnetic member disposed interiorly of and spaced from said tubular member.

7. A printing machine according to claim 6, wherein said electrical biasing means includes a voltage source.

8. A printing machine according to claim 7, further including means for forming a test area on the photoconductive member with said transporting means being adapted to deposit marking particles thereon.

9. A printing machine according to claim 8, wherein said generating means includes a densitometer positioned adjacent said photoconductive member for measuring the mass to area ratio of the marking particles deposited on the test area and generating a signal indicative thereof.

10. A printing machine according to claim 9, wherein the processing station being regulated by the control signal from said producing means discharges marking particles.

11. A printing machine according to claim 9, wherein the processing station being regulated by the control signal from said producing means charges the photoconductive member.

12. A printing machine according to claim 9, wherein the processing station being regulated by the control signal from said producing means exposes the charged portion of the photoconductive member to record the latent image thereon.

13. A printing machine according to claim 9, wherein the processing station being regulated by the control signal from said producing means controls said electrical biasing means

* * * * *